US005916676A

United States Patent [19]

Stasi

[11] Patent Number: 5,916,676

[45] Date of Patent: Jun. 29, 1999

[54] ANTIFRAGMENTATION PLATES BASED ON ACRYLIC POLYMERS

[75] Inventor: Alberto Luca Stasi, Milan, Italy

[73] Assignee: Atohaas Holding C.V., Netherlands

[21] Appl. No.: 08/917,111

[22] Filed: Aug. 25, 1997

[30] Foreign Application Priority Data

Aug. 28, 1996 [IT] Italy ..... MI96A1795

[51] Int. Cl.[6] ..... D02G 3/00

[52] U.S. Cl. ..... 428/364; 428/68; 428/105; 428/110; 428/203; 428/902; 428/911; 428/339; 428/426; 52/309.1

[58] Field of Search ..... 428/110, 203, 428/105, 220, 255, 339, 245, 426, 911, 247, 902, 68, 76, 364; 52/309.1, 309.7, 289

[56] References Cited

U.S. PATENT DOCUMENTS 4,631,214 12/1986 Hasegawa ..... 428/68

5,040,352 8/1991 Oberlander et al. ..... 52/789

5,372,866 12/1994 Oberlander et al. ..... 428/110

FOREIGN PATENT DOCUMENTS 0 769 595 A1 10/1996 European Pat. Off. .

29 06 259 2/1979 Germany .

85 35 183 12/1985 Germany .

92 16 548 4/1992 Germany .

*Primary Examiner*—William Krynski

*Assistant Examiner*—Abraham Bahta

*Attorney, Agent, or Firm*—Nikaido, Marmelstein, Murray & Oram, LLP

[57] ABSTRACT

Antinoise and antifragmentation plates based on acrylic polymers containing filaments of plastic material placed at a distance comprised between 20 and 35% of the thickness with respect to the surface opposite to impact.

13 Claims, No Drawings

ANTIFRAGMENTATION PLATES BASED ON ACRYLIC POLYMERS

BACKGROUND OF THE INVENTION

1. Field of the Invention

The present invention relates to plates based on acrylic polymers to be used as barriers having antinoise and antifragmentation properties.

In particular it relates to transparent polymethylmethacrylate plates having a high thickness, in the range of 12–25 mm, preferably 15–20 mm, for motorway barriers, viaducts, bridges, etc.

2. Description of the Related Art

It is well known to utilize acrylic panels rather than other materials in the construction of antinoise barriers, to be utilized in motorway.

The technical problem arises when a blunt instrument crashes into the panel thus determining the formation of fragments which fall in the road area.

The same problem arises in case of viaducts and bridges causing danger situations for what is situated under these structures.

It is known to build protective barriers against this fragmentation by means of nets wrapping the panel. However the net meshes must have wide sizes otherwise the panel does not show any more transparence phenomena, necessary for the practical applications of these panels. The alternative utilized in practice consists in employing nets with large meshes to allow a certain transparence. The drawback of this technical solution resides in that the antifragmentation of the net results in this way very reduced. Moreover, to maintain a certain transparence, panels must be subject to very frequent cleaning operations since nets favor the accumulation of substances lowering the transparence, for instance dust, leaves, etc. This requires the taking down of nets with the consequent increase of maintenance costs.

The same drawbacks as regards the transparence occur even though nets are inserted into the panel, even if in this way the cleaning operation described above is eliminated.

From patent U.S. Pat. No. 5,040,352, transparent antifragmentation panels based on acrylic resins are knwon, which contain about in the middle of the panel threads, fibers, bands and nets of plastic material. In particular the materials indicated as suitable for the reinforcement of acrylic panels are monofilaments of polyamide or polypropylene due to their poor adhesion to the acrylic glass.

The preferred sizes for monofilaments are 0.2–2 mm of diameter. The preferred sizes for plastic bands which can consist of films or fibers, have a width from 5 to 25 mm and a thickness from 0.2 to 2 mm.

The distance between the filaments or the bands must be in the range from 10 to 100 mm.

The advantage of these plastic materials inserted about in the middle of the panel is due to the fact that they are transparent enough and therefore reduce the problems of reduced transparence with respect to the art and avoid the cleaning operations due to the environmental pollution being inside the panel. The antifragmentation properties result good.

The teaching of said patent is very precise as to the placing of threads in manufactured articles, in addition to the size, the threads direction which can be perpendicular or forming an angle different from 90°. Both the description and the exemplifying part point out that threads must be inserted about in the middle of the thickness of the panel.

BRIEF SUMMARY OF THE INVENTION

The Applicant has unexpectedly and surprisingly found, and this is an object of the present invention, that it is possible to carry out antinoise and antifragmentation plates based on acrylic polymers by utilizing filaments of plastic material placed at a distance comprised between 20 and 35% of the total thickness of the plate pith respect to the surface opposite to the surface subject to impact.

DETAILED DESCRIPTION OF THE INVENTION

Tests carried out by the Applicant (see the examples) have shown that the results obtained in terms of antifragmentation properties are good as well with respect to the placing of threads approximately placed in the middle of the thickness of the plate as described in the art.

A further object of the present invention consists in antifragmentation plates containing two series of filaments of plastic material placed near the two surfaces of the plate, at the same distances indicated above. In this case it has been noticed that antifragmentation and crash-resistance properties have improved in comparison with the plate of the art with threads approximately placed in the middle. This result is surprising since tests carried out by the Applicant have shown that if only one series of threads near the surface subject to crash is utilized, the antifragmentation properties are poor and of no industrial interest.

Alternatively to the threads of plastic material, fibers, plastic bands or plastic nets can be utilized.

Monofilaments are preferred among filaments. As monofilaments those of polyamide and polypropylene can be mentioned. The monofilaments sizes are generally comprised between 0.1 and 4 mm, preferably between 2 and 3 mm. The distance among bands is generally from 10 to 100 mm, the bands size being 5–25 mm and having a thickness equal to that of the monofilaments.

According to the present invention monofilaments are preferably utilized.

The threads utilized to confer antifragmentation properties can be clearly seen in the final plate.

The panels having an acrylic basis according to the present invention can be obtained in various ways according to the usual technologies for preparing panels, preferably by casting.

The panels with threads according to the present invention can be resistant to an impact energy according to the tests as described hereunder.

TEST A

A 125 mm×125 mm sample with the thickness of 14–15 mm of a PMMA plate containing inside the threads according to the present invention, is placed on a square support having an opening in the middle of 90 mm of diameter. A weight of 15.5 kg having a steel hemispheric punch with a diameter of 20 mm is let fall in the middle of the plate, by adjusting the impact energy depending on the test piece thickness and on the break energy of the material, so as to have the real breaking of the test piece.

It is determined in this way if the panel breaks without causing fragments, i.e. if fragments are kept by the threads.

TEST B

A 250 mm×250 mm sample with a thickness of 14–15 mm obtained by a PMMA plate containing inside threads according to the present invention, is placed on a square support having sides of 255 mm and a support frame of a 10 mm width. A weight having a steel spheric punch with a diameter of 50 mm is let fall in the middle of the plate, (the punch weight is indicated in the examples), by adjusting the impact energy depending on the test piece thickness and on the breaking energy of the material, so as to have the real breaking of the test piece.

By polymers having an acrylic basis according to the present invention are meant MMA homopolymers, MMA copolymers with other comonomers such as ethyl(meth) acrylate, butyl(meth)acrylate in low concentrations. The amounts of comonomer are generally up to 10% by weight. MMA homopolymers or copolymers can be obtained by polymerization according to the usual techniques, for instance by bulk or mass polymerization. The molecular weight can be adjusted with the addition of suitable chain transfer agents, for instance of the mercaptans class. The weight average molecular weights $M_w$ can generally be comprised in the range from 50,000–2,000,000.

The lowest values of molecular weight being preferred for the production of plates by (co)extrusion; the highest ones for preparing plates by casting.

The following examples are given only for illustrative purpose but are not limitative of the present invention.

EXAMPLE 1

A test piece with a thickness of 15 mm obtained by a cast PMMA plate is tested according to the conditions of test A. The polyamide threads with a diameter of 2 mm and a distance of about 30 mm from each other are inside the plate at a distance of 11 mm from the sample face subject to crash. The impact tests were carried out by utilizing three different impact rates: 1.6; 2; 3 m/sec. The punch strikes the plate surface in the zone comprised between two threads.

The plates breaking energy is comprised on average between 1.2 and 2 J/mm (tests carried out on 10 samples). Some samples break in more parts which are kept together by the polyamide threads. Other samples on the contrary break in two distinct parts, in their turn formed by plate fragments kept together by the polyamide threads. Still others do not show breaking.

EXAMPLE 2

A test piece with a thickness of 15 mm obtained by a cast PMMA plate is tested according to the conditions of test A. Two series of parallel polyamide threads with a diameter of 2 mm and distant about 30 mm from each other are inside the plate at a distance of about 4 mm from the surfaces. Tests were carried out by utilizing an impact rate: 1.6; 2; 3 m/sec. The punch strikes the plate between two threads as indicated in Example 1. The plates breaking energy is on average comprised between 1.2 and 1.7 J/mm (tests carried out on 10 samples). Some samples break in more parts which are kept together by the polyamide threads. Other samples on the contrary break in two distinct parts, in their turn formed by plate fragments kept together by the polyamide threads. At any rate the antifragmentation properties result better in comparison with a plate with one series of threads, since the distance among the various fragments kept together by the polyamide threads results on average lower than a sample of equal thickness with a series of threads placed in the middle of the test piece. Other samples do not show breaking.

EXAMPLE 3

A test piece as obtained in Example 2 was tested according to the conditions of test B. Tests were carried out with a weight of 4 kg let fall from a height of 2 m. The punch strikes the plate between two threads as indicated in Example 1. The samples break in more parts which are kept together by the polyamide threads. At any rate the antifragmentation property results better in comparison with a plate of equal thickness with only one series of threads placed in the middle of the test piece. Indeed the space among the various fragments kept together by the polyamide threads on average results lower in the conditions of the present example.

I claim:

1. Antinoise and antifragmentation plates based on acrylic polymers containing filaments of plastic material placed in an asymmetrical position at a distance comprised between 20 and 35% of the total thickness of the plate with respect to the surface opposite to the surface subject to crash.

2. Antinoise and antifragmentation plates containing two series of filaments of plastic material placed in an asymmetrical position at a distance from the surfaces of the plate comprised between 20 and 35% of the total thickness of the plate.

3. Antinoise and antifragmentation plates based on acrylic polymers containing filaments of plastic material according claim 1, wherein the filaments of plastic material are replaced by fibers, plastic bands or plastic nets.

4. Aitinoise and antifragmentation plates based on acrylic polymers containing filaments of plastic material according claim 1, constituted by monofilaments.

5. Antinoise and antifragmentatlon plates based on acrylic polymers containing filaments of plastic material according to claim 4, wherein monofilaments are selected from polyamide and polypropylene.

6. Antinoise and antifragmentation plates based on acrylic polymers containing filaments of plastic material according claim 4, wherein monofilaments have sizes comprised between 0.1 and 4 mm.

7. Antinoise and antifragmentation plates based on acrylic polymers containing filaments of plastic material according claim 1, wherein said polymers having an acrylic basis are MMA homopolymers, MMA copolymers with comonomers ethyl(meth)acrylate, or butyl(meth)acrylate in which the comonomer amounts are up to 10% by weight.

8. Antinoise and antifragmentation plates based on acrylic polymers containing filaments of plastic material according to claim 7, wherein the weight average molecular weights $M_w$ of polymers having an acrylic basis are comprised in the range of 50,000–2,000,000.

9. Antinoise and antifragmentation plates based on acrylic polymers containing filaments of plastic material according to claim 2, wherein the filaments of plastic material are replaced by fibers, plastic bands or plastic nets.

10. Antinoise and antifragmentation plates based on acrylic polymers containing filaments of plastic material according to claim 2, wherein said filaments are constituted by monfilaments.

11. Antinoise and antifragmentation plates based on acrylic polymers containing filaments of plastic material according to claim 10, wherein monofilaments have sizes comprised between 0.1 and 4 mm.

12. Antionoise and antifragmentation plates based on acrylic polymers containing filaments of plastic material according to claim 2, wherein said polymers having an acrylic basis are MMA hompolymes, MMA coplymers with comonomers ethyl(meth)acrylate, or butyl(meth)acrylate in which the comonomer amounts are up to 10% by weight.

13. Antinoise and antifragmentation plates based on acrylic polymers containing filaments of plastic material according to claim 12, wherein the weight average molecular weights $M_w$ of polymers having an acrylic basis are comprised in the range of 50,00–2,000,000.

* * * * *